US007824576B2

(12) United States Patent
Pereira et al.

(10) Patent No.: US 7,824,576 B2
(45) Date of Patent: Nov. 2, 2010

(54) DISPERSION STRENGTHENED LITHIUM AND METHOD THEREFOR

(75) Inventors: Nino R Pereira, Springfield, VA (US); M Ashraf Imam, Great Falls, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/729,733

(22) Filed: Mar. 23, 2010

(65) Prior Publication Data

US 2010/0176348 A1 Jul. 15, 2010

Related U.S. Application Data

(62) Division of application No. 11/551,756, filed on Oct. 23, 2006.

(51) Int. Cl.
*G21F 1/08* (2006.01)
*C22C 24/00* (2006.01)
*E06B 3/00* (2006.01)

(52) U.S. Cl. ..... 252/478; 252/62.3 R; 252/62.3 E; 252/62.3 C; 252/600; 420/400; 52/202; 52/204.5; 52/782.1

(58) Field of Classification Search ..... 252/478; 420/400; 52/202, 204.5
See application file for complete search history.

(56) References Cited

U.S. PATENT DOCUMENTS

| | | | | |
|---|---|---|---|---|
| 3,158,994 | A * | 12/1964 | Hodgson | 60/220 |
| 3,159,104 | A * | 12/1964 | Hodgson | 102/284 |
| 3,836,798 | A * | 9/1974 | Greatbatch | 310/303 |
| 4,235,863 | A * | 11/1980 | Schulten et al. | 423/658.2 |
| 4,247,327 | A * | 1/1981 | Plewes | 148/684 |
| 4,605,547 | A * | 8/1986 | Dumousseau et al. | 423/646 |
| 6,514,478 | B2 * | 2/2003 | Zaluska et al. | 423/644 |
| 2001/0014309 | A1 * | 8/2001 | Zaluska et al. | 423/646 |
| 2003/0113252 | A1 * | 6/2003 | Chen et al. | 423/414 |
| 2008/0093585 | A1 * | 4/2008 | Pereira et al. | 252/478 |

* cited by examiner

*Primary Examiner*—Joseph D Anthony
(74) *Attorney, Agent, or Firm*—Amy Ressing; Rebecca Forman

(57) ABSTRACT

A composite material includes lithium hydride particles dispersed within lithium to form a lithium-lithium hydride composite. The lithium-lithium hydride composite has increased strength over pure lithium and similar soft X-ray transmission characteristics as pure lithium. A soft X-ray blast window may be made from the lithium-lithium hydride composite with increased reliability and cost effectiveness. A method for making a composite material includes dispersing lithium hydride into lithium metal using a variety of dispersion techniques.

10 Claims, 1 Drawing Sheet

DISPERSION STRENGTHENED LITHIUM AND METHOD THEREFOR

The present application is a divisional application that claims the benefit of patent utility application Ser. No. 11/551,756 to Pereira et al., filed Oct. 23, 2006 entitled "DISPERSION STRENGTHENED LITHIUM AND METHOD THEREFOR," the entire contents of which is incorporated herein by reference.

FIELD OF THE INVENTION

The present invention is generally directed to strengthened lithium metal and the manufacture thereof.

BACKGROUND OF THE INVENTION

Soft X-ray blast windows (or filters) transmit soft X-rays but hold back the blast from an explosive X-ray source. Unlike hard X-rays, such as those conventionally used in medical X-ray devices, soft X-rays do not transmit well through most materials and are instead absorbed by the material. Generally, soft x-ray blast windows are used for conducting soft X-ray tests in laboratory radiation simulators. The earliest soft X-ray windows were foils from either beryllium or strong plastics known to transmit at least some soft X-rays, such as KAPTON, MYLAR or Kimfol. However, due to its toxic nature, beryllium becomes a health hazard when it is vaporized by the radiation from an explosive X-ray source. Thus, beryllium is not suited as a soft X-ray blast window. Moreover, beryllium is expensive. Meanwhile, the plastics discussed above are low-cost, but not nearly as strong as beryllium and they absorb soft X-rays much more than desirable.

Lower atomic number materials absorb soft X-rays less, and therefore make better windows for soft X-rays. However, these nontraditional materials bring with them many problems. For example, the highest X-ray transmission is offered by solid deuterium, the lowest atomic number material, and X-ray filters have been developed from solid deuterium. While a solid deuterium window transmits even the softest X-rays of interest when testing surfaces for their response to intense radiation pulses, solid deuterium windows are stable only at cryogenic temperature below about 6K and under vacuum conditions, which are expensive and cumbersome.

Thus, a soft X-ray window was developed from pure lithium metal, a low atomic number material that is a solid at room temperature. While lithium will transmit soft X-rays, but not as well as deuterium does, the majority of soft X-rays useful for testing will transmit through lithium. Also, lithium is relatively stable making it a good material for blast windows. However, lithium is not a particularly strong material. To address the problem of strength, lithium windows are made more effective in transmitting soft X-rays by supporting them on a compliant grid of strong wires. The grid compensates for the low strength of the lithium metal itself in the same way that nylon wires reinforce strapping tape. However, the wires are made from higher atomic number material, such as stretched polyethylene, and thus absorb some of the soft X-rays, reducing overall soft X-ray transmission. In addition, the lithium material can be made stronger by cooling the material to 77 K. At such cryogenic temperatures, all metals become stronger, harder and more brittle, but lithium remains ductile down to at least 77K. Thus, a grid support for lithium at 77K can have wires that are farther apart than a grid support at room temperature, letting more X-rays through, without sacrificing strength of the window. However, cryogenic cooling requires additional equipment, expense and is sometimes considered too complicated for implementation by operators not accustomed to dealing with cryogenic systems. Beryllium, on the other hand, becomes too brittle at cryogenic temperatures to be effective.

It is therefore desirable to find alternatives that have effective X-ray transmission similar to lithium while having increased strength even without cryogenics. It would be an additional advantage if this same material were to show the additional increase in strength on cryogenic cooling and/or when placed on a grid as lithium does.

BRIEF SUMMARY OF THE INVENTION

One embodiment of the present invention is directed to a composite material including lithium hydride particles dispersed within lithium to form a lithium-lithium hydride composite. The lithium-lithium hydride composite has increased strength over pure lithium and similar soft X-ray transmission characteristics as pure lithium. Another embodiment of the present invention is directed to a soft X-ray blast window made from the lithium-lithium hydride composite.

Another embodiment of the present invention is directed to a method for making a lithium-lithium hydride composite which includes dispersing lithium hydride into lithium metal using a variety of dispersion techniques.

The foregoing and other features and advantages of the present invention will be apparent from the following, more particular description of a preferred embodiment of the invention and as illustrated in the accompanying drawings.

DETAILED DESCRIPTION OF THE INVENTION

Figure 1:
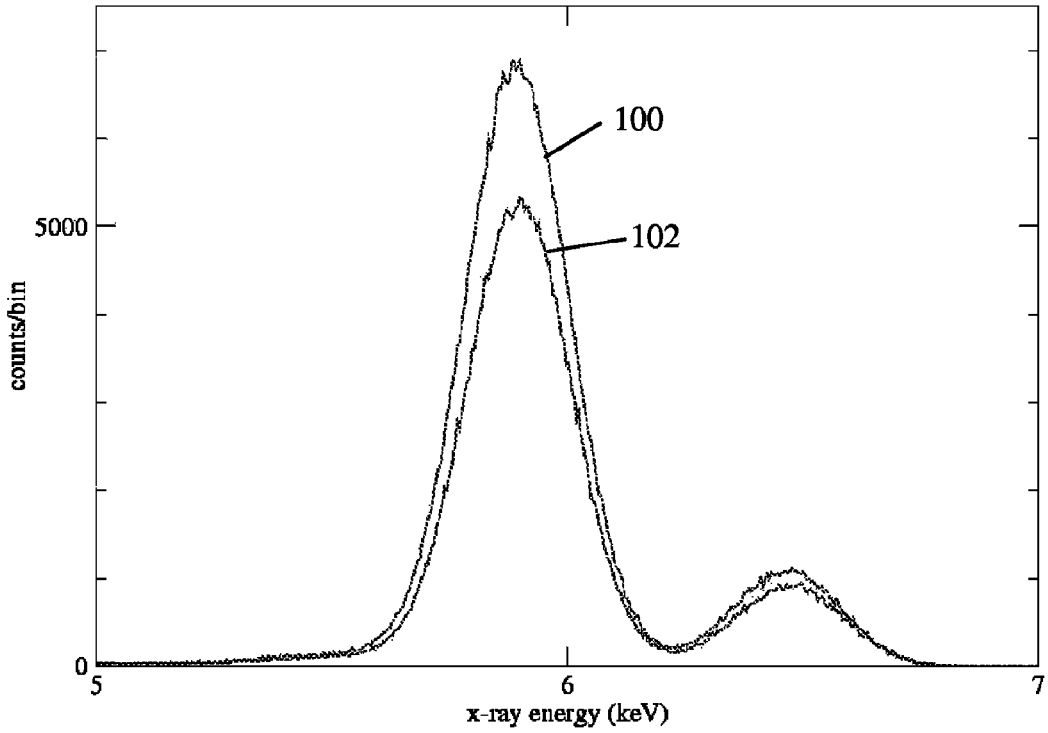
FIG. 1 is a graph comparing the transmission of 5.9 kilo-electron volts (keV) X-rays through equal thickness lithium and lithium-lithium hydride composite materials.

The present invention is directed towards increasing the strength of a soft X-ray transmitting material, lithium, with a dispersion of lithium hydride particles to form a lithium-lithium hydride composite. The present invention maintains lithium's excellent soft X-ray transmission characteristics while making the lithium stronger. In particular, small, hard particles are dispersed throughout a softer metal to increase the metal's strength. Because of the desire for excellent soft X-ray transmission in the final material, in a preferred embodiment, the strengthening particles preferably transmit soft X-rays similar to that of lithium. As discussed above, as the atomic number of the material decreases, the soft X-ray transmission increases. Thus, preferably the particles have only atoms with the same or lower atomic numbers than lithium. Hence, the preferred dispersed material for use in a soft X-ray blast window is lithium hydride. For various other applications, the particles may be another composition that is consistent with that particular application.

Dispersing particles into a metal matrix has been achieved for metals such as iron, aluminum and titanium. These metals are commonly subjected to alloying and thermo-mechanical treatment that results in materials that are harder and stronger than the pure metal itself. The effect is usually obtained through a reaction of the pure metal with admixtures that results in hard particles dispersed throughout the metal, hence referred to as dispersion strengthening. Dispersion strengthening of lithium with lithium hydride is preferred because lithium hydride maintains lithium's high X-ray transmission and is a hard, ionic solid that is well suited for strengthening purposes.

Generally, the finer the dispersed particles the more the strength increases. See, for example, V. Provenzano et al., "On the validation of a strengthening concept," *Scr. Metall. Mat.,* 24, 2065-2070 (1990). The present invention considers the selection of the proper concentrations of lithium hydride dispersed in a lithium matrix and the process for successfully dispersing the hard particles of lithium hydride throughout the softer lithium matrix for the proper application, as would be apparent to one skilled in the art through routine experimentation. Another aspect of the present invention is the material itself, since one skilled in the art may identify alternative methods for manufacturing the lithium-lithium hydride composite of the present invention.

Several methods may be used to disperse lithium hydride into a lithium matrix. For example, a lithium-lithium hydride composite may be made by sprinkling a fine lithium hydride powder on lithium foil. The lithium foil is then folded over once or multiple times and rolled out after every one or few foldings to the desired thickness, for example, to about the original thickness of the foil. As it is rolled, the lithium hydride particles become embedded within the lithium to form a lithium-lithium hydride composite.

The lithium hydride powder, for example, having an average diameter of about 75 microns, may be obtained from any secondary chemical supplier, such as Aldrich or Alfa Aesar, or directly from a manufacturer such as Chemetall Foote. The lithium foil may be obtained directly from the same chemical supplier or rolled in situ from a lithium rod, also available from the same chemical suppliers. Preferably, the lithium foil is battery-quality with a very high purity, for example at least 99% pure, preferably 99.999% pure. In alternative embodiments, the purity of the lithium foil may be less than 99% pure. The appropriate purity of lithium may be determined by one skilled in the art for a particular application considering that impurities having larger atomic numbers than lithium increase the absorption of soft X-rays, thus reducing the overall X-ray transmission rate through the material and that impurities in the lithium increase the strength of the material.

Lithium hydride may be sprinkled by hand at room temperature in the inert atmosphere of a glove box or in a dry room. The lithium foil can be any size in principle, for example, the lithium foil may be about 50 square millimeters. The folded lithium foil may be, for example, rolled by hand with a smooth stainless steel rod that is tens of millimeters in diameter or by another rolling method that may be apparent to one skilled in the art.

Lithium hydride may be sprinkled in any concentration. However, the material may eventually becomes too brittle to roll out smoothly at a maximum concentration of lithium hydride. Further, contaminants, such as nitrogen or oxygen may be included during this process. Nitrogen and oxygen may already have been present on the surface of the lithium hydride powder during manufacture. Alternatively, minute quantities of water, oxygen and/or nitrogen may remain in glove boxes with standard purification and even if the glove box atmosphere were to be further purified by sprinkling a layer of lithium hydride powder throughout the glove box itself. In addition, lithium metal is protected by an oxide layer, similar to aluminum foil. Oxygen from the oxide layer may be folded into the lithium along with the lithium hydride. The oxide layer may be even thicker when the lithium comes as a foil, since foils are made by extrusion in dry air. These contaminants have higher atomic numbers than lithium itself and, thus, may be accompanied by unacceptably large X-ray absorption. However, one skilled in the art may prepare a lithium-lithium hydride composite with excellent soft X-ray transmission by this method by avoiding these concerns.

Another method for dispersing lithium hydride powder in lithium includes mechanically mixing molten lithium metal and lithium hydride powder. The lithium metal may be available from the same suppliers as mentioned above. The lithium metal may be molten in a stainless steel cup, for example. The lithium hydride powder may be available from the same suppliers as mentioned above.

The lithium metal and lithium hydride powder may be mixed in a proportion that can be varied up to the point that the lithium hydride no longer mixes homogeneously with the molten lithium, for example, up to approximately 50% by weight lithium hydride. Molten lithium (or any molten metal) has a very high surface tension that prevents wetting of the powder by the liquid metal. Mixing of lithium and lithium hydride powder may be assisted by increasing the pressure, for example, using a consolidation technique known as high isostatic pressing (HIP), or heat pressing. In the absence of the proper hot press equipment needed for HIP, however, the liquid metal and the lithium hydride powder alternatively may be aided in mixing by increasing the temperature above the 180° C. melting point of lithium metal. One suitable temperature may be slightly above 400° C., e.g., 415° C. Lithium hydride may mix with liquid lithium better at higher temperature due to lithium's lower surface tension at higher temperature. Additionally, lithium hydride is in thermodynamic equilibrium with lithium and hydrogen at 680° C. and at atmospheric pressure hydrogen. However, under low partial pressure of hydrogen, the temperature for thermodynamic equilibrium is much less than 680° C. When the equilibrium is exceeded, hydrogen will begin to disassociate from the surfaces of the lithium hydride particles, leaving smaller lithium hydride particles with a lithium coating. The lithium coated lithium hydride particles will more easily mix into molten lithium.

The present invention also contemplates using alternative methods or additional steps to improve the dispersing of lithium hydride powder within lithium. Many methods currently exist to mix small particles, and other methods exist to improve the homogeneity of the mix. Any such method may be suitable for use in the dispersing method of the present invention. Particularly included may be other methods known to make a homogeneous mix of a powder with a liquid metal, such as methods typically used for strengthening aluminum by interspersing soft aluminum with hard aluminum oxide. One embodiment for dispersing lithium hydride in lithium may include spraying hot, liquid lithium droplets, for example from a spray nozzle, into an atmosphere of cold hydrogen. The lithium droplets should be sprayed at a temperature where it reacts fast enough with the gaseous hydrogen and at a suitable pressure to make the reaction produce the desired thickness of a lithium hydride layer on a lithium particle. Compressing the lithium hydride coated lithium particles in a hydrostatic press under an inert atmosphere and at a suitable temperature should break up the lithium hydride coating and result in a lithium matrix interspersed with lithium hydride.

In alternative embodiments, such a method may include varying the size of the metal particles, for example, by altering a liquid metal spray nozzle, varying the speed of the hydrogen stream across the lithium nozzle, or varying the pressure or temperature of the hydrogen.

In another embodiment, lithium powder may be mixed with lithium hydride powder by mechanical mixing methods.

The powder/powder mixture may then be consolidated, for example using a heat press or other methods apparent to one of ordinary skill in the art. In another embodiment of the dispersing method of the present invention, hydrogen gas may be bubbled through molten lithium. At sufficiently high pressure, portions of the hydrogen will converted to lithium hydride and will be dispersed throughout the molten lithium. In yet another embodiment, mixing may be improved by shaking the lithium hydride particles with strong acoustic waves in an ultrasonic regime, for example, at above 20 kHz. One skilled in the art may also appreciate that there may be other alternative methods or additional steps that provide the lithium and lithium hydride composite of the present invention.

The material of the present invention, a lithium-lithium hydride composite having lithium hydride uniformly dispersed into lithium, has not been successfully manufactured before the present invention. The lithium-lithium hydride composite improves the performance of blast windows for soft X-rays by increasing the strength of the window over a window made of lithium alone without significant loss in X-ray transmission as compared to pure lithium. Even if the addition of impurities in the lithium-lithium hydride composite causes a slight reduction in soft X-ray transmission compared to pure lithium, the lithium-lithium hydride composite is sufficiently stronger than lithium that it allows additional design improvements to blast windows for soft X-rays. These better designed blast windows actually have improve functioning over blast windows made with pure lithium alone. As a result, the lithium-lithium hydride composite, even with impurities, can replace weaker pure lithium. Further, the lithium-lithium hydride composite is much competitive with beryllium, particularly when considering beryllium's cost, size, availability and health related drawbacks.

Example 1

X-Ray Transmission

FIG. 1 demonstrates that the lithium-lithium hydride composite of the present invention maintains sufficient soft X-ray transmission required for soft X-ray blast windows. FIG. 1 compares the soft X-ray transmission through lithium, curve 100, with that of the lithium-lithium hydride composite of the present invention, curve 102. In this example, the lithium-lithium hydride composite is about a 50%-50% weight percent mixture of the two components. To verify the soft X-ray transmission, FIG. 1 illustrates the transmission of 5.9 kilo-electron volts (keV) X-rays from about 1 megaBecquerel (MBq) of radioactive iron-57 that was passed through a 11.3 mm thick piece of lithium, curve 100, compared to a 11.3 mm thick piece of the lithium-lithium hydride material of the present invention, curve 102.

The data in FIG. 1 was provided by an Amptek Multi-Channel analyzer. FIG. 1 shows that, for the same thickness of material, pure lithium transmits about 25% more 5.9 keV X-rays than the lithium-lithium hydride composite of the present invention. As demonstrated in FIG. 1, in windows of the same thickness, the lithium-lithium hydride composite absorbs soft X-rays slightly more than pure lithium, even though the overall atomic number should be slightly less in the lithium-lithium hydride composite. These results are primarily due to the increased density of a lithium-lithium hydride composite window over a pure lithium window. The lithium-lithium hydride composite is estimated to be about 10% to about 15% more dense than lithium, depending upon the concentration of lithium hydride. More particularly, the density will be between about 0.534 g/cm$^3$, which is the density of pure lithium, and about 0.79 g/cm$^3$, which is the density of pure lithium hydride. However, the lithium-lithium hydride composite material, with its strength greatly improved can be made much thinner than 11.3 mm. As the thickness of the lithium-lithium hydride composite material decreases, the soft X-ray transmission rate will increase, since the overall density will decrease. As such, nearly identical X-ray transmission rates will be evident in a thinner, yet stronger, lithium-lithium hydride composite window when compared to a thicker pure lithium window.

As discussed above, the excess soft X-ray absorption demonstrated in FIG. 1 may also be somewhat attributed to contamination in the lithium hydride material used to make the lithium-lithium hydride composite of the present invention. However, impurities can be reduced below those characteristic of the commercially available lithium hydride by, for example, using lithium hydride of higher purity that may be available from Oak Ridge National Laboratory, which has in its charter the production of highly pure lithium hydride as needed by the US Department of Energy, or by, for example, including a purifying step prior to adding the lithium hydride to lithium. Nonetheless, the small increase in soft X-ray absorption in the lithium-lithium hydride composite of the present invention over pure lithium demonstrated in FIG. 1 does not detract from the lithium-lithium hydride composite's utility as a soft X-ray window. This is particularly true considering that the use of higher purity lithium hydride, while desirable, may become cost prohibitive in that a commercially available lithium hydride with a purity of 99.4% is about twice the cost of lithium hydride with a purity of 98%. Further, for the same mass per unit area, the lithium-lithium hydride composite of the present invention will have better soft X-ray transmission than beryllium.

Example 2

Strength

The lithium-lithium hydride composite of the present invention rivals beryllium in strength, for the same X-ray transmission value. In other words, if a beryllium window, a lithium window and a lithium-lithium hydride composite window were all designed to transmit the same amount of soft X-rays, the window made from intrinsically strong and dense beryllium would be thinner than the lithium window. The lithium-lithium hydride composite window would be marginally thinner than the pure lithium window, due to the higher density of lithium-lithium hydride over pure lithium, but also would be stronger than either the thicker lithium or the thinner beryllium window. When compared at the same thickness, however, the beryllium window would be stronger than the lithium-lithium hydride window, but the reduction in soft X-ray transmission in the equal thickness beryllium would be significant.

Figure 2:
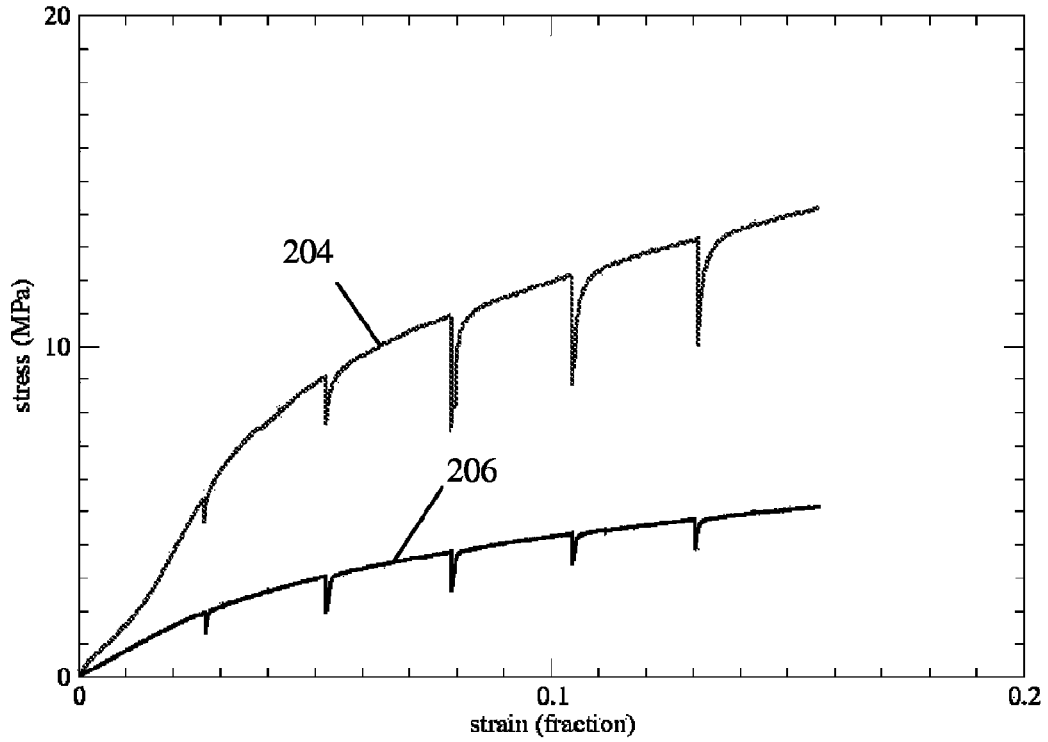
FIG. 2 is a graph comparing the stress and strain for lithium and lithium-lithium hydride composite materials.

FIG. 2 illustrates that the lithium-lithium hydride composite of the present invention is much stronger and is thus superior to pure lithium for use in blast windows for soft X-rays. The stress-strain curves 204/206 of FIG. 2 show the force needed for a cylindrical rod, an indenter, to penetrate a certain depth lithium-lithium hydride composite, curve 204, and pure lithium, curve 206. On occasion, the indenter is pulled back, allowing each material to spring back in accordance with its elastic properties. In measuring the strength of the materials, particularly for use in blast windows, both the force needed to deform the material elastically and the maximum force that can be absorbed by inelastic deformation before the material breaks should be considered.

FIG. 2 indicates that a lithium-lithium hydride composite of the present invention, with approximately 50% weight lithium hydride powder, is about four times stronger than pure lithium metal. The maximum force that can be absorbed by inelastic deformation in the material before the material breaks is proportional to the area below curves 204/206 in FIG. 2. Generally for metal compositions, an increase in concentration of the base material and a lower concentration of added harder material are not as strong as a 50%-50% by weight mixture. Thus, less than 50% by weight concentration of lithium hydride in lithium is likely weaker than the 50% weight lithium-lithium hydride composite, the strength of which is demonstrated in FIG. 2. However, lower concentration lithium hydride matrices likely have a larger maximum strain and, therefore, may have a larger energy absorption potential. Compositions with a lower concentration of lithium hydride may be weaker but may show larger strain before breaking, while those with a concentration of lithium hydride up to about 50% by weight may be stronger but may break at lower strain. However, unless clumping of lithium hydride can be avoided by some of the various techniques apparent to one of ordinary skill in the art, concentration much greater than 50% by weight of lithium hydride may become brittle.

As discussed above, the lithium-lithium hydride composite of the present invention is not limited to 50%-50% by weight composite of lithium and lithium hydride, with particle sizes as supplied commercially. Rather the present invention contemplates the use of a variety of concentrations and particle shapes, sizes and distributions, since any addition of lithium hydride to lithium is an improvement in strength over pure lithium. One of ordinary skill in the art will be able to determine optimum composition for various purposes through routine experimentation. For example, about a 50% by weight lithium hydride composite may be appropriate for a soft X-ray blast window application or alternative concentrations may provide better results as would be apparent to one of ordinary skill in the art. Other features that affect the strength and soft X-ray transmission characteristics of the lithium-lithium hydride composite are the shape, size and distribution of the lithium hydride particles. As such, the particle size, shape and distribution of the lithium hydride may be altered for various applications as would be apparent to one of ordinary skill in the art by routine experimentation.

Cryogenic cooling may further increase the strength of lithium-lithium hydride composite of the present invention over a lithium-lithium hydride composite at room temperature as would be apparent to one of ordinary skill in the art. Further, a support grid may be added to the lithium-lithium hydride composite for use in even stronger or thinner blast windows.

While the invention has been particularly shown and described with reference to preferred embodiments thereof, it will be understood by those skilled in the art that they have been presented by way of example only, and not limitation, and various changes in form and details can be made therein without departing from the spirit and scope of the invention. Thus, the breadth and scope of the present invention should not be limited by any of the above-described exemplary embodiments, but should be defined only in accordance with the following claims and their equivalents. Additionally, all references cited herein, including issued U.S. patents, or any other references, are each entirely incorporated by reference herein, including all data, tables, figures, and text presented in the cited references. Also, it is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein.

What is claimed as new and desired to be protected by Letters Patent of the United States is:

1. A blast window comprising a lithium-lithium hydride composite material, comprising:

lithium; and lithium hydride particles dispersed within the lithium to form a lithium-lithium hydride composite.

2. The blast window of claim 1, wherein the concentration of lithium is about 50% by weight and the concentration of lithium hydride is about 50% by weight.

3. The blast window of claim 1, wherein the concentration of lithium is greater than 50% by weight and the concentration of lithium hydride is less than 50% by weight.

4. The blast window of claim 1, wherein the lithium-lithium hydride composite is stronger than pure lithium.

5. The blast window of claim 1, wherein the lithium-lithium hydride composite having equal soft X-ray transmission as pure lithium is thinner and stronger than pure lithium.

6. The blast window of claim 1, wherein the lithium-lithium hydride composite transmits more soft X-rays than equal thickness of beryllium.

7. The blast window of clam 1, wherein the X-ray transmission through the lithium-lithium hydride composite is less than about 25% less than that of the same thickness of pure lithium.

8. The blast window of claim 1, wherein the purity of the lithium hydride is greater than about 98% pure.

9. The blast window of claim 1, wherein the purity of the lithium is greater than about 99% pure.

10. The blast window of claim 1, wherein the lithium-lithium hydride composite is strengthened by a support grid.

* * * * *